United States Patent [19]

Filipeli

[11] 4,038,776

[45] Aug. 2, 1977

[54] ROCKET TOY

[75] Inventor: James Michael Filipeli, Woodland Hills, Calif.

[73] Assignee: A. J. Filipeli Co., Inc., Woodland Hills, Calif.

[21] Appl. No.: 700,390

[22] Filed: June 28, 1976

[51] Int. Cl.[2] ..... A63H 33/20

[52] U.S. Cl. ..... 46/76 A; 46/86 C; 124/65

[58] Field of Search ..... 46/76 R, 76 A, 76 B, 46/76 C, 86 R, 86 B, 86 C; 124/65

[56] References Cited

U.S. PATENT DOCUMENTS

| | | | |
|---|---|---|---|
| 2,449,187 | 9/1948 | Walters | 124/65 |
| 2,997,809 | 8/1961 | Gladen | 46/86 C |
| 3,301,246 | 1/1967 | Wolfe | 124/65 |
| 3,445,954 | 5/1969 | Wahl | 46/86 C |
| 3,903,801 | 9/1975 | Senoski | 46/86 C |

*Primary Examiner*—Russell R. Kinsey
*Assistant Examiner*—Robert F. Cutting
*Attorney, Agent, or Firm*—Howard A. Silber

[57] ABSTRACT

A rocket toy has a unitary cylindrical body with outwardly projecting fins and a partition wall across the interior near the front end. A tapered cylindrical lip projecting from the body front end receives one of two nose cones. The first, a parachute-receiving nose cone, fits loosely on the tapered lip and is held in place during forward flight by the air resistance of a forwardly facing brake surface on the nose cone exterior. A parachute, furled within the nose cone, has cords attached by an elastic band to the rocket body. After launch, as the rocket toy slows down near the apex of its trajectory, the air resistance is insufficient to hold on the nose cone. The nose cone drops away, permitting the parachute to deploy. The second nose cone fits tightly on the tapered lip and remains in place throughout the entire flight. The rocket toy is launched by the compression of air within a pair of telescoped tubes, one of which is connected to the rocket body cylindrical rear end during launch.

14 Claims, 5 Drawing Figures

Fig. 5
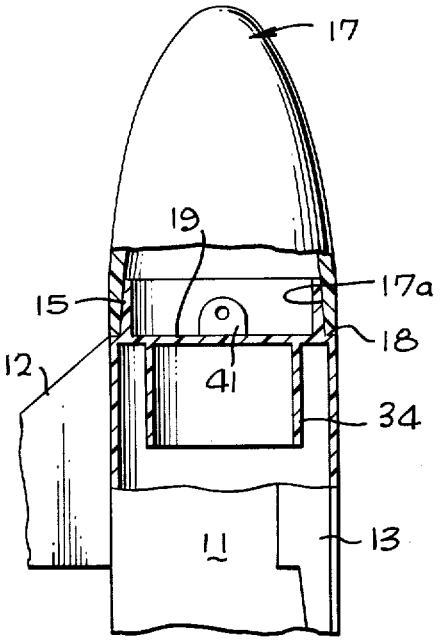
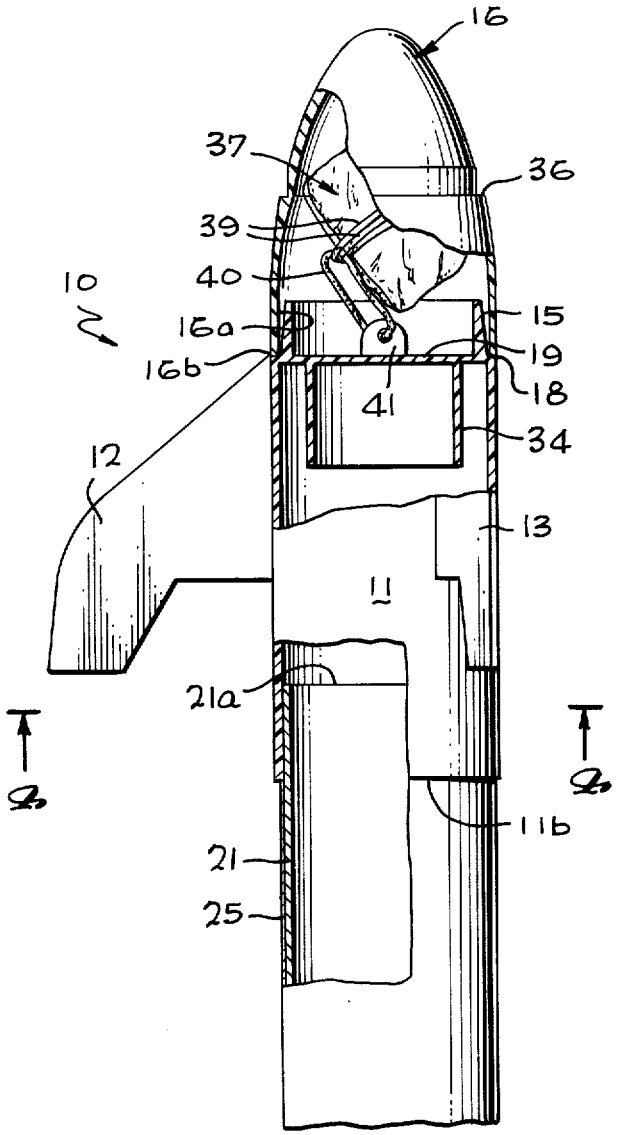
Fig. 3
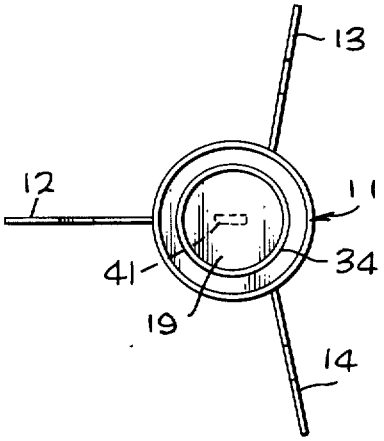
Fig. 4

ROCKET TOY

BACKGROUND OF THE INVENTION

1. Field of the Invention

The present invention relates to a rocket toy having a nose cone that drops off in flight to permit deployment of a parachute attached to the rocket body.

2. Description of the Prior Art

The excitement of the space age has led to the widespread popularity of toys related to rocketry and space adventure. Unfortunately, most rocket toys seek realism by complexity, and thus are very expensive. A profusion of rocket models can be bought at low cost, but for the most part these are merely decorative. They are placed on a display shelf, and offer no source of active amusement or test of skill to the owner. An object of the present invention is to provide a rocket toy that is realistic yet inexpensive, and which provides the user with activity and test of skill.

Several steps accompany the flight of a rocket in sub-orbital trajectory. Typically, these include the launch, stage separation during upward flight or at the apex of the trajectory, and reentry and recovery of the rocket, often with the use of a parachute. Another object of the present invention is to simulate these steps in a rocket toy. Other rockets are designed to operate without stage separation or recovery; these may be used as interceptors. A further object of the inventive toy is to simulate such interceptor rocket operation.

SUMMARY OF THE INVENTION

These and other objectives are achieved in a rocket toy having a cylindrical body equipped with fins that provide stability during flight. The forward end of the rocket body includes a tapered cylindrical lip that receives one of two nose cones. The first is loose fitting, and houses a parachute. The air resistance of a brake surface on the nose cone exterior holds the nose cone in place during forward flight. As the rocket toy slows down near the apex of the trajectory, the air resistance is reduced, permitting the nose cone to drop away and the parachute to be deployed. The second nose cone is tight fitting. It remains attached to the rocket body throughout flight, thus permitting simulation of interceptor operations.

The rocket toy is launched using a pair of tubes that are telescoped together to compress air against a partition wall within the rocket interior. The cylindrical body is dimensioned to fit on the end of one of the telescoping tubes during launch. The rocket body and nose cones advantageously are fabricated of molded plastic for light weight and low cost.

BRIEF DESCRIPTION OF THE DRAWINGS

A detailed description of the invention will be made with reference to the accompanying drawings wherein like numerals designate corresponding parts in the several figures.

FIG. 3 is a side view, partly broken away and in section, of the rocket body, furled parachute and loose-fitting nose cone all in place for launch with the rocket body at the end of the launch tube.

FIG. 4 is a bottom view of the rocket body, as seen along the line 4—4 of FIG. 3.

FIG. 5 is a fragmentary side view, partly broken away and in section, of the rocket body and tight-fitting nose cone used for "interceptor" operation.

DESCRIPTION OF THE PREFERRED EMBODIMENT

Figures 1, 2:
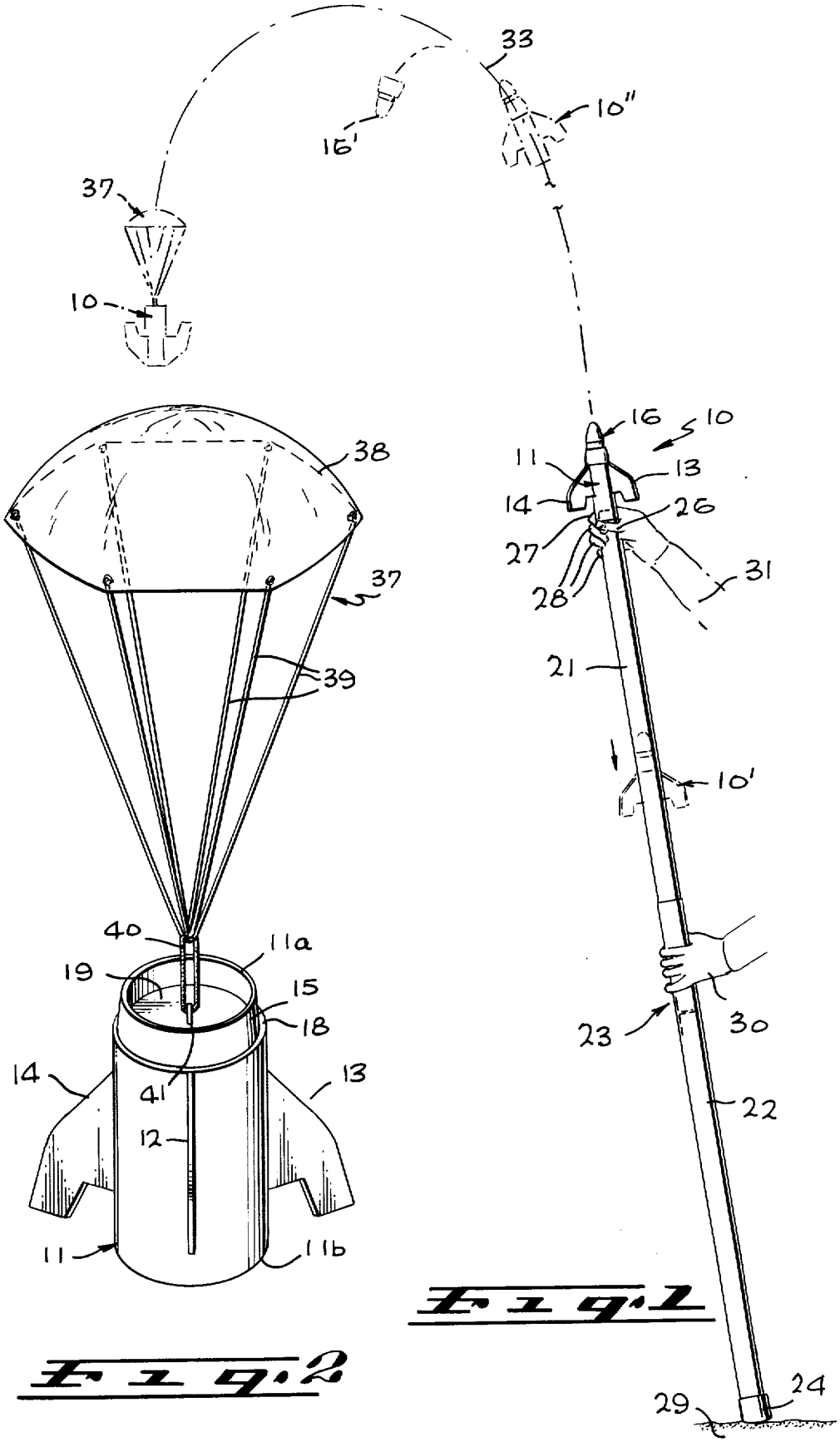
FIG. 1 is a pictorial view showing the launch and flight of the inventive rocket toy in the parachute recovery mode.
FIG. 2 is a pictorial view of the rocket body and deployed parachute.

The following detailed description is of the best presently contemplated mode of carrying out the invention. This description is not to be taken in a limiting sense, but is made merely for the purpose of illustrating the general principles of the invention since the scope of the invention is best defined by the appended claims.

Referring to FIGS. 1 through 4, the inventive rocket toy 10 includes a unitary body 11 advantageously formed of molded polyproplyene or other plastic. The body 11 is generally cylindrical and has three outwardly projecting fins 12, 13, 14 disposed as shown in FIG. 4. These provide stability in flight.

Projecting forwardly at the front end 11*a* of the body 11 is a tapered cylindrical lip 15 which receives either a loose-fitting nose cone 16 (FIG.3) or a tight-fitting nose cone 17 (FIG. 5). The tapered lip 15 has a maximum diameter at its base. This maximum diameter is somewhat smaller than the outside diameter of the cylindrical body 11, so as to form a shoulder 18. Typically, the cylindrical lip 15 is tapered at an angle of about 5°.

A partition wall 19 closes the cylindrical interior of the body 11 near the front end of the rocket toy. The rear end 11*b* is open to receive the inner one of a pair of telescoping tubes 21, 22 which together form the launcher 23 for the rocket toy 10. The lower end of the tube 22 is closed by a plastic cap 24. The outer surface of the tube 21 is covered with a foil 25 (FIG. 3) to reduce friction during sliding insertion of the tube 21 into the tube 22.

To launch the rocket toy 10, the open end 11*b* of the rocket body 11 is placed over the open end 21*a* of the launch tube 21, as shown in FIGS. 1 and 3. The inside diameter of the cylindrical body 11 is just slightly larger than the outside diameter of the tube 21. The rocket toy is held in place during launch by gripping the rocket body 11 between the thumb 26 and forefinger 27 of the user, with the other fingers 28 being wrapped about the tube 21. The lower tube 22, situated with its closure 24 resting on the ground 29, is gripped by the other hand 30. Using a downward movement of the arm 31, the tube 21 is telescoped rapidly into the stationary tube 22. During this downward motion, the rocket toy 10 is held in place on the end of the tube 21, as indicated in phantom at 10' in FIG. 1. The telescoping action compresses the air within the launcher 23. The force of this compressed air acts against the partition wall 19, and forces the rocket toy 10 to fly off of the launcher 23 and to travel through the flight trajectory indicated by the broken line 33.

During launch, lateral flow of the compressed air parallel to the underside of the partition wall 19 is prevented by a short cylinder 34 (FIGS. 3–5) which depends rearwardly from the partition wall 19. By preventing such lateral flow, the upward force of the compressed air against the partition wall 19 is maximized.

The nose cone 16 is used in parachute recovery operation. As shown in FIG. 3, this nose cone 16 has an open, cylindrical rear end 16*a* that is not tapered. The inside diameter of the rear cylindrical portion 16*a* is equal to the maximum outer diameter of the tapered lip 15. As a result, the nose cone 16 seats loosely over the lip 15, with its lower edge 16b abutting against the shoulder 18 of the rocket body 11.

During forward flight, the nose cone 16 is held against the rocket body 11 by the force of air striking an annular shoulder 36. The shoulder 36 thus forms an air flow resisting brake surface that interrupts the otherwise streamlined exterior of the nose cone 16. The shoulder 36 of course faces forward, and in the embodiment shown is annular and surrounds the entire nose cone 16. However, the invention is not so limited, and the brake surface could be differently configured. The requirement is that it present an air flow resisting surface of sufficient area so that during forward flight, the force of air striking the brake surface will maintain the nose cone 16 in place against the rocket body 11.

As the rocket toy 10 nears the apex of the trajectory 33 (as indicated at 10'' in FIG. 1), the forward speed decreases. As a result, less force is exerted against the brake surface 36. Eventually this force will be insufficient to hold the nose cone 16 against the rocket body 11. The nose cone will drop away, as shown at 16' in FIG. 1. This permits deployment of a parachute 37 that is furled within the nose cone 16 during launch (FIG. 3).

Referring to FIGS. 2 and 3, the parachute 37 comprises a canopy 38 of plastic or other light, flexible material. A set of cords 39 connect the canopy 38 to an elastic loop 40. This loop 40 passes through an eyelet 41 projecting from the forward surface of the partition wall 19. Use of the elastic band 40 aids in deployment of the parachute 37 and stabilizes the fall of the rocket body 10. However, use of the elastic band 40 is not necessary, and the cords 39 could be attached directly to the rocket body 11.

Prior to launch, the parachute 37 is furled or rolled into a small package with the cords 39 coiled about its exterior, as shown in FIG. 3. The furled parachute is placed within the cup-like interior of the cylindrical lip 15, covered by the nose cone 16 as shown in FIG. 3. When the nose cone 16 drops off during flight, the parachute deploys as shown in FIGS. 1 and 2. The rocket body 10 floats back to the ground, simulating parachute recovery of a rocket.

The interceptor nose cone 17 (FIG. 5) has a smooth exterior with no brake surface. The interior **17*a* near its open end is tapered at the same angle as the exterior surface of the tapered lip 15. As a result, when the nose cone 17 is placed on the rocket body 11 as shown in FIG. 5, a tight frictional contact is established between the entire exterior surface of the lip 15 and the interior nose cone surface 17*a*. As a result, the nose cone 17 will remain in place on the rocket body 11 throughout the entire flight trajectory. Use of the nose cone 17** thus simulates interceptor rocket flight.

The particular fin configuration is not critical. However, the use of three fins 12–14 positioned as shown in FIG. 4 results in stable flight. It has the further benefit that during launch, when gripped as shown in FIG. 1, the fins will not strike against the user's knuckles during downward telescopic motion of the launcher 23.

Intending to claim all novel, useful and unobvious features, shown or described, the inventor:

1. A rocket toy comprising:

a unitary, generally cylindrical rocket body having a set of fins projecting outwardly therefrom, a partition wall closing the cylindrical interior of said rocket body near the front end thereof, and a nose-cone receiving tapered cylindrical lip projecting forwardly from said body front end, a parachute-retaining nose cone having a streamlined exterior surface and dimensioned for loose-fitting reception by said cylindrical lips, there being an air flow resisting brake surface interrupting the streamlined exterior surface, air resistance against said brake surface holding said nose cone onto said rocket body during forward flight of said rocket toy, and a parachute having cords attachable to said rocket body, said parachute being furlable for retention within said nose cone, said parachute-retaining nose cone dropping off of said rocket body when the rocket toy slows down during flight, thereby permitting said parachute to deploy.

2. A rocket toy according to claim 1 together with launcher means for launching said rocket toy by air compression against the interior of said rocket body rearward of said partition wall.

3. A rocket toy according to claim 1 wherein said launcher means comprises a pair of telescoping cylindrical tubes, one of said tubes being closed at one end only, the other tube being open at both ends and dimensioned for reception of the open rear end of said rocket body, rapid telescoping of said tubes with said rocket body held onto an end of said other tube causing sufficient compression of the air withn said launcher means to impart forward flight to said rocket toy.

4. A rocket toy according to claim 3 wherein said other tube fits within said one tube having the closed end, the outer surface of said other tube being covered with foil to reduce friction during rapid telescopic insertion within said one tube, the outside diameter of said other tube being just slightly less than the inside diameter of said rocket body cylindrical interior, thereby permitting said rocket body to be inserted over the other tube end during launch of said toy.

5. A rocket toy according to claim 2 wherein within said cylindrical interior, rearward of said partition wall, there is provided a baffle to limit air flow parallel to said partition wall during launch.

6. A rocket toy according to claim 1 wherein said brake surface comprises an annular shoulder formed on said nose cone exterior surface and having a forwardly facing air-flow resisting surface.

7. A rocket toy according to claim 6 wherein the rear end of said nose cone is interiorly cylindrical with an inside diameter substantially equal to the maximum outside diameter of said rocket body cylindrical lip, so that said nose cone cylindrical rear end will be loosely, matingly received by said lip.

8. A rocket toy according to claim 1 wherein said rocket body includes an eyelet, and wherein said parachute cords are attached to said eyelet via an elastic band.

9. A rocket toy according to claim 1 together with another nose cone usable alternately to said parachute-retaining nose cone, said other nose cone having no brake surface and having an open, conical rear end dimensional for tight fit over said nose-cone-receiving cylindrical lip, so that said other nose cone will not drop off of said rocket body despite slowdown during flight.

10. A rocket toy according to claim 1 wherein said rocket body and said nose cone are formed of moded plastic.

11. A rocket toy comprising:

a unitary rocket body having (a) fins, (b) an interior that is open at the rear end and closed nearer the front end, and (c) a nose-cone-receiving tapered member at the front end of said body, and a first nose cone adapted for loose fitting reception by said tapered member, and having an air-flow-resisting brake surface on its exterior, air flow against said brake surface keeping said first nose cone attached to said body during forward flight of said toy, said first nose cone dropping from said body when said toy slows down during flight.

12. A rocket toy according to claim 11 together with:

a second nose cone, usable alternately said first nose cone, said second nose cone having no brake surface and being configured for tight fitting reception by said tapered member so as to remain attached to said rocket body throughout flight of said toy.

13. A rocket toy according to claim 11 together with a parachute having cords that are attached by an elastic band to said rocket body, said parachute being furled within said first nose cone during the initial flight of said rocket toy, said parachute being deployed when said first nose cone drops from said body during flight.

14. A rocket toy according to claim 11 together with a launcher comprising a pair of telescoping tubes, closed at one end and open at the other end, said rocket body open end engaging said other end of said launcher, so that telescopic shortening of said tubes compresses air against said rocket body closed interior to launch said rocket toys, said fins being positioned on said rocket body to avoid striking contact with the hands of the user during launch.

* * * * *